United States Patent [19]

Takeuchi et al.

[11] Patent Number: 4,547,234

[45] Date of Patent: Oct. 15, 1985

[54] EXPLOSIVE COMPOSITION

[75] Inventors: Fumio Takeuchi; Masao Takahashi; Hiroshi Sakai, all of Aichi, Japan

[73] Assignee: Nippon Oil and Fats Company Limited, Tokyo, Japan

[21] Appl. No.: 627,781

[22] Filed: Jul. 5, 1984

[30] Foreign Application Priority Data

Jul. 15, 1983 [JP] Japan ..... 58-127557

[51] Int. Cl.[4] ..... C06B 45/18

[52] U.S. Cl. ..... 149/3; 149/14; 149/38; 149/41; 149/43; 149/44; 149/46; 149/47; 149/60; 149/61; 149/62; 149/70; 149/77; 149/78; 149/83; 149/85; 149/92; 149/110

[58] Field of Search ..... 149/3, 14, 41, 43, 44, 149/46, 60, 47, 38, 61, 62, 70, 77, 78, 83, 85, 92, 110

[56] References Cited

U.S. PATENT DOCUMENTS

| | | | |
|---|---|---|---|
| 3,899,374 | 8/1975 | Sylkhouse | 149/2 |
| 4,141,766 | 2/1979 | Cameron et al. | 149/2 |
| 4,151,022 | 4/1979 | Donaghue et al. | 149/60 |
| 4,369,689 | 1/1983 | Donaghue et al. | 149/7 |

*Primary Examiner*—Stephen J. Lechert, Jr.
*Attorney, Agent, or Firm*—Parkhurst & Oliff

[57] ABSTRACT

An explosive composition containing micro-voids consisting of thermoplastic resin hollow microspheres coated with a thermosetting resin has a remarkably excellent low temperature detonability in a small diameter cartridge after lapse of a long period of time.

11 Claims, No Drawings

EXPLOSIVE COMPOSITION

BACKGROUND OF THE INVENTION

1. Field of the Invention

The present invention relates to an explosive composition containing micro-voids, and more particularly relates to an explosive composition containing specifically limited hollow microspheres as micro-voids and having an improved low temperature detonability represented by the lowest detonation temperature after lapse of a long period of time in a small diameter cartridge having a diameter of 25 mm.

2. Description of the Prior Art

There have been used various kinds of micro-voids in industrial explosives in order to lower the density of an explosive and to improve the detonation properties, such as detonation sensitivity, propagation property of detonation, and the like.

The term "micro-voids" means hollow microspheres, bubbles formed from a foaming agent, bubbles formed by blowing mechanically (physically) air into the raw material mixture of the explosive, and the like.

Explosives containing bubbles have a drawback that the bubbles leak gradually from the explosives during a storage for a long period of time and the detonation properties of the explosives become poor.

While, explosives containing hollow microspheres are seldom in the leakage of gas contained in the microspheres from the explosives during the storage, but have the following drawbacks.

That is, when inorganic hollow microspheres, such as glass, volcanic ash and the like, are intended to be used as hollow microspheres, a large amount of inorganic hollow microspheres must be used in order to produce an explosive having a low specific gravity, because the density of the inorganic hollow microspheres is higher than 0.1 g/cc due to their inherent property and to the thickness of the shell wall. Accordingly, the use of inorganic hollow microspheres is disadvantageous from the viewpoint of the strength of the resulting explosive due to the quite inertness of the microspheres at the explosion and further is disadvantageous from the viewpoint of the cost of the microspheres. Furthermore, many kinds of inorganic hollow microspheres have a high mechanical strength and are hardly broken under a low pressure, and therefore an explosive containing inorganic hollow microspheres is small in the amount of heat to be supplied to the explosive by the adiabatic compression of gas, which is contained in the interior of the inorganic hollow microspheres and acts as an initiator for the detonation of the explosive, and hence the explosive is low in the detonation sensitivity.

In order to obviate these drawbacks, there has been attempted to improve the detonation property of an explosive without deteriorating its strength by containing hollow microspheres made of resin (hereinafter, referred to as resin hollow microspheres) in the explosive, which resin acts as a combustible material at the explosion of the explosive.

As the resin hollow microspheres, there are known thermoplastic resin hollow microspheres and thermosetting resin hollow microspheres.

For example, there have been disclosed in U.S. Pat. No. 3,773,573 that dynamite, gelatinized nitromethane explosive, cast explosive and slurry explosive, which contain 0.1–2% by weight of thermoplastic resin hollow microspheres consisting of a vinylidene chloride-acrylonitrile-methyl methacrylate terpolymer resin (hereinafter referred to as Saran (registered trademark by Dow Chemical Co.)) and having a density of 0.032 g/cc and a particle size of 5–100 μm, are superior to those containing inorganic hollow microspheres or phenolic thermosetting resin hollow microspheres in the strength due to the reactivity of the terpolymer resin.

Further, there has been proposed, in U.S. Pat. No. 4,110,134, a water-in-oil emulsion explosive, which contains 0.24–1% by weight of Saran thermoplastic resin hollow microspheres or phenolic thermosetting resin hollow microspheres, each hollow microspheres having a density of 0.032 g/cc and an average particle size of 30 μm, and can be detonated after a lapse of one year or more in a small diameter cartridge (1.25 inch diameter) by means of a No. 6 blasting cap without containing explosive sensitizer and detonation catalyst.

However, these resin hollow microspheres have a shell wall consisting of a single layer formed of thermoplastic resin or thermosetting resin, and have the following drawbacks.

The thermoplastic resin hollow microspheres have a low density, that is, have a thin shell wall, and hence they are apt to be easily compressed even under a relatively low pressure and are often broken during the production of explosive. Moreover, the thermoplastic resin has a softening point, and therefore when some kinds of explosives, for example, water-gel explosive, which are required to be mixed with hollow microspheres at high temperature in the production thereof, are produced, the thermoplastic resin hollow microspheres are easily broken due to the heat and pressure, to which the explosives are exposed during the production.

When a part of hollow microspheres are broken during the production of an explosive containing the hollow microspheres, gas contained therein leaks during storage of the explosive for a long period of time, and as a result the explosive has not a satisfactorily high detonation sensitivity at low temperature after lapse of a long storage time. Further, an explosive containing hollow microspheres, a part of which have been broken during the production of the explosive, is poor in the resistance against shock from pre-explosion in an adjacent bore hole at the blasting face, and hence the explosive is apt to be misfired and remain, and is disadvantageous in view of the safety maintenance.

While the thermosetting resin hollow microspheres have a relatively high density, and hence they have the same drawbacks as those of the above described inorganic hollow microspheres. That is, in order to produce an explosive having a low specific gravity, a relatively large amount of at least 1% by weight of thermosetting resin hollow microspheres must be contained in the explosive. As the result, the oxygen balance of the explosive is apt to be negative, and the after-detonation fume thereof is apt to be ill due to uncomplete detonation. Furthermore, the thermosetting resin hollow microspheres are hardly broken due to their relatively thick shell wall, and therefore an explosive containing the thermosetting resin hollow microspheres is small in the amount of heat to be supplied to the explosive by the adiabatic compression of gas, which is contained in the interior of the thermosetting resin hollow microspheres and acts as an initiator for the detonation of the explosive, and hence the explosive is low in the detonation sensitivity.

SUMMARY OF THE INVENTION

The inventors have made various investigations in order to overcome the drawbacks of explosive compositions containing the above described conventional mocro-voids, and found out that, when an explosive contains specifically limited hollow microspheres which are not broken during the production of the explosive and do not cause ill after-detonation fume by the explosion of the explosive, the explosive has a remarkably lowest detonation temperature in a small diameter cartridge (25 mm diameter) after lapse of a long period of time, and have accomplished the present invention.

That is, the feature of the present invention lies in the provision of an explosive composition containing micro-voids, the improvement comprising the micro-voids being formed of thermoplastic resin hollow microspheres coated with a thermosetting resin.

DESCRIPTION OF THE PREFERRED EMBODIMENT

The specifically limited hollow microspheres to be used in the present invention are thermoplastic resin hollow microspheres coated with a thermosetting resin, and have a two layer-structured shell wall contrary to conventional hollow microspheres having a single layer-structured shell wall.

As the thermoplastic resin constituting the inside wall of the specifically limited hollow microspheres to be used in the present invention, use is made of, for example, vinylidene chloride-acrylonitrile-methyl acrylate terpolymer resin, acrylonitrile-methyl methacrylate copolymer resin, vinylidene chloride-acrylonitrile-methyl methacrylate terpolymer resin, vinylidene chloride-acrylonitrile-vinyl acetate terpolymer resin, vinylidene chloride-acrylonitirle copolymer resin, vinylidene chloride-acrylonitrile-ethyl acrylate terpolymer resin, vinylidene chloride-methyl methacrylate copolymer resin, acrylonitrile-vinyl acetate copolymer resin and the like. Among them, vinylidene chloride-acrylonitrile-methyl acrylate terpolymer resin, acrylonitrile-methyl methacrylate copolymer resin, vinylidene chloride-acrylonitrile-methyl methacrylate terpolymer resin and vinylidene chloride-acrylonitrile-vinyl acetate terpolymer resin are preferable.

As raw material hollow microspheres for the specifically limited hollow microspheres to be used in the present invention, there can be used hollow microspheres, which have been obtained by heating and foaming and expanding unfoamed hollow microspheres, said unfoamed hollow microspheres consisting of a shell wall formed of one of the above described thermoplastic resins, and a low bonding point hydrocarbon, such as isobutane or the like, included in the shell wall, into hollow microspheres having an average particle size of 10–100 μm and a density of 0.005–0.08 g/cc, preferably 0.007–0.06 g/cc.

As the above described hollow microspheres, there can be used unfoamed "Matsumoto Microsphere F-20 or F-30" (trademarks) sold by Matsumoto Yushi-Seiyaku Co., unfoamed "Matsumoto Microsphere F-50 or F-60" (trademarks) made by the same company, and unfoamed or foamed "Expancel" (trademark) sold by Kemanord Co., Ltd.

As the thermosetting resin to be used for coating the outside of the above described thermoplastic resin hollow microspheres, use is made of, for example, melamine-formaldehyde resin, phenol-formaldehyde resin, urea-formaldehyde resin, resorcinol-formaldehyde resin, epoxy resin, unsaturated polyester resin, silicone resin, furan resin and the like.

As the above described melamine-formaldehyde resin, for example, "Ulamine P6100" (trademark) sold by Mitsui Toatsu Chemicals Inc. can be used; as the phenol-formaldehyde resin, for example, "Sumilite Resin PR-968" (trademark) sold by Sumitomo Bakelite Co., Ltd. can be used; as the urea-formaldehyde resin", for example, "Igetalime UA-90530" (trademark) sold by Sumitomo Bakelite Co., Ltd. can be used; and as the resocinol-formaldehyde resin, for example, "Sumilite Resin PR-150" (trademark) sold by Sumitomo Bakelite Co., Ltd. can be used.

The specifically limited hollow microspheres of the present invention, which have a two-layered structure consisting of the above described thermoplastic resin hollow microspheres coated with the above described thermosetting resin, have an average particle size of about 20–150 μm and a density of about 0.007–0.1 g/cc, preferably 0.01–0.07 g/cc. In thermoplastic resin hollow microspheres coated with a thermosetting resin, ones having an average particle size of less than 20 μm are difficulty produced, and ones having an average particle size of more than 150 μm are apt to lower the detonation velocity of the resulting explosive; and further ones having a density of less than 0.007 g/cc are difficultly produced, and ones having a density of more than 0.1 g/cc are apt to lower the detonation sensitivity of the resulting explosive. Therefore, hollow microspheres having an average particle size or a density outside the range defined in the present invention can not be advantageously used.

The above described specifically limited hollow microspheres to be used in the present invention are contained in an explosive composition in an amount of 0.05–4% by weight, preferably 0.1–3% by weight, based on the total amount of the explosive composition. When the amount is less than 0.05% by weight, the effect of the present invention can not be fully attained. While, when the amount exceeds 4% by weight, the explosive composition is apt to be low in the detonation velocity and is apt to be negative in the oxygen balance, resulting in an ill after-detonation fume.

The present invention can be applied to all the commonly known explosives containing micro-voids, for example, water-gel explosive, dynamite, gelatinized nitromethane explosive, cast explosive, ammonium nitrate fuel oil mixture and the like.

The water-gel explosive includes commonly known slurry explosive and oil-in-water emulsion explosive.

The slurry explosive includes all the commonly known slurry explosive compositions, and, for example, comprises an inorganic oxidizer salt consisting mainly of ammonium nitrate; water; a combustible material, such as formamide, ethylene glycol, aluminum powder or the like; an organic sensitizer, such as monomethylamine nitrate or the like; a thickener, such as guar gum or the like; and micro-voids.

The water-in-oil emulsion explosive includes all the commonly known water-in-oil emulsion explosive compositions, and, for example, comprises a disperse phase formed of an aqueous oxidizer solution consisting of water and an inorganic oxidizer salt consisting mainly of ammonium nitrate; a continuous phase formed of a combustible material consisting of oil, such as microcrystalline wax, liquid paraffin or the like; an emulsifier; and micro-voids.

A typical method for producing the specifically limited hollow microspheres to be used in the present invention will be explained hereinafter.

Unfoamed hollow microspheres made of a commercially available thermoplastic resin (for example, Saran) are foamed and expanded into a desired average particle size and a desired density by stirring them at a high speed in warm water kept at a proper temperature, and then cold water is added to the mass to stop the foaming and expansion.

The resulting thermoplastic resin hollow microspheres are added to warm water kept at a proper temperature together with a thermosetting resin (for example, melamine-formaldehyde resin) to disperse homogeneously the thermoplastic resin hollow microspheres in the water and to dissolve homogeneously the thermosetting resin in the water. Then, a 5% aqueous solution of sulfuric acid is added to the dispersion and the resulting mass is stirred for a given period of time to obtain the thermoplastic resin hollow microspheres coated with the thermosetting resin.

Explosives can be produced through a conventional method by using the resulting hollow microspheres in place of commonly used micro-voids.

The following examples are given for the purpose of illustration of this invention and are not intended as limitations thereof. The method for producing the specifically limited hollow microspheres to be used in the Examples is described in the following Reference examples. In the examples, "parts" are all in weight basis.

REFERENCE EXAMPLE 1

To warm water kept at 80°–85° C. was added 200 g of unfoamed hollow microspheres of vinylidene chloride-acrylonitrile-methyl methacrylate terpolymer resin (trademark: Matsumoto Microsphere F-30, sold by Matsumoto Yushi-Seiyaku Co.), and stirred therein at a high speed to be foamed and expanded. After about 2 minute stirring, cold water was added to the mass to cool it to a temperature of not higher than 60° C. and to stop the foaming and expansion. The resulting hollow microspheres had an average particle size of 40 μm and a density of 0.022 g/cc.

Then, 150 g of the resulting hollow microspheres was stirred at a high speed in 20 l of warm water kept at 50°–55° C. to disperse the hollow microspheres in the water. Then, 150 g of melamine-formaldehyde resin (trademark: Ulamine 6100, sold by Mitsui Toatsu Chemicals Inc.) was homogeneously dissolved in the dispersion of the hollow microspheres under stirring, and further 500 g of a 5% aqueous solution of sulfuric acid was added to the dispersion, and the resulting mixture was further stirred for 2 hours to obtain the vinylidene chloride-acrylonitrile-methyl methacrylate terpolymer resin hollow microspheres coated with the melamine-formaldehyde resin (hereinafter, abbreviated as M-coated SaMB). The resulting hollow microspheres had an average particle size of 50 μm and a density of 0.03 g/cc.

REFERENCE EXAMPLE 2

The procedure of Reference example 1 was repeated, except that phenol-formaldehyde resin (trademark: Sumilite Resin PR-968, sold by Sumitomo Bakelite Co., Ltd.) was used in place of melamine-formaldehyde resin used in Reference example 1, to obtain the vinylidene chloride-acrylonitrile-methyl methacrylate terpolymer resin hollow microspheres coated with the phenol-formaldehyde resin (hereinafter, abbreviated as P-coated SaMB). The resulting hollow microspheres had an average particle size of 60 μm and a density of 0.035 g/cc.

REFERENCE EXAMPLE 3

The procedure of Reference example 1 was repeated, except that acrylonitrile-methyl methacrylate copolymer resin hollow microspheres (trademark: Matsumoto Microsphere F-50, sold by Matsumoto Yushi-Seiyaku Co.) was used in place of the vinylidene chloride-acrylonitrile-methyl methacrylate terpolymer resin hollow microspheres, and urea-formaldehyde resin (trademark: Igetalime UA-90530, sold by Sumitomo Bakelite Co., Ltd.) was used in place of the melamine-formaldehyde resin, to obtain the acrylonitrile-methyl methacrylate copolymer resin hollow microspheres coated with the urea-formaldehyde resin (hereinafter, abbreviated as U-coated AcMB). The resulting hollow microspheres had an average particle size of 30 μm and a density of 0.032 g/cc.

REFERENCE EXAMPLE 4

The procedure of Reference example 3 was repeated, except that a foaming and expansion temperature of 70°–75° C. was used in place of 80°–85° C., resorcinol-formaldehyde resin (trademark: Sumilite Resin PR-150, sold by Sumitomo Bakelite Co., Ltd.) was used in place of the urea-formaldehyde resin, and paraformaldehyde was used in place of the 5% aqueous solution of sulfuric acid, to obtain the acrylonitrile-methyl methacrylate copolymer resin hollow microspheres coated with the resorcinol-formaldehyde resin (hereinafter, abbreviated as R-coated AcMB). The resulting hollow microspheres had an average particle size of 30μ and a density of 0.062 g/cc.

EXAMPLES 1–5

Slurry explosives having a compounding recipe shown in Examples 1–5 in the following Table 1 were produced in the following manner.

Into a vertical type kneader was first charged 14.3 parts of water, and then charged a dispersion of 0.2 part of guar gum in 9.0 parts of formamide, and the resulting mixture was stirred to obtain a gelled product.

Then, to the gelled product were added 50.9 parts of ammonium nitrate, 12.8 parts of sodium nitrate and 12.8 parts of aluminum powder, and the resulting mixture was kneaded at a rate of 30 rpm until a homogeneous mixture was obtained. The resulting homogeneous mixture was mixed with a given amount of each of the hollow microspheres obtained in the above described Reference examples 1–4, and the resulting mixture was further kneaded into a homogeneous mixture to obtain a slurry explosive.

Each of the resulting slurry explosives was charged into a polyethylene tube having a diameter of 25 mm to produce a sample cartridge having an explosive content of 100 g, which was used in the following performance tests:

(A) density (g/cc) of the explosive just after the production;

(B) lowest detonation temperature (hereinafter, abbreviated as MIT) (°C.) of the explosive just after the production, which is determined by detonating the explosive by means of a No. 6 blasting cap at a temperature interval of 5° C.;

(C) amount (l/kg) of carbon monoxide (CO) and that (l/kg) of nitrogen oxide (NOx) contained in the after-detonation fume generated in the explosion of 1 kg of the explosive just after the production;

(D) strength of the explosive just after the production, which is represented by the ballistic mortar ratio (hereinafter, abbreviated MB) (%) measured according to JIS;

(E) density of the explosive after one year from the production; and (F) MIT(°C.) of the explosive after one year from the production.

The obtained results are shown in Table 1.

EXAMPLES 6–10

Slurry explosives having a compounding recipe shown in Examples 6–10 in Table 1 were produced in the following manner.

Into a vertical-type kneader provided with a heating means and a heat-insulating means was firstly charged 10 parts of hot water kept at 90° C., and then 54.3 parts of ammonium nitrate and 25 parts of monomethylamine nitrate were dissolved in the water to obtain an aqueous solution kept at 70° C. of the nitrates. The aqueous solution was then stirred together with a dispersion of 0.7 part of guar gum in 10 parts of formamide to obtain a gelled product.

The gelled product was kneaded together with a given amount of each of the hollow microspheres obtained in above described Reference examples 1–4 until a homogeneous mixture was obtained, to obtain a slurry explosive. A sample cartridge was produced from the resulting slurry explosive in the same manner as described in Examples 1–5, and subjected to the same performance tests as described in Examples 1–5. The obtained results are shown in Table 1.

TABLE 1

| | | Example | | | | | | | | | |
|---|---|---|---|---|---|---|---|---|---|---|---|
| | | 1 | 2 | 3 | 4 | 5 | 6 | 7 | 8 | 9 | 10 |
| Compounding recipe (parts by weight) | Ammonium nitrate | | | 50.9 | | | | | 54.3 | | |
| | Sodium nitrate | | | 12.8 | | | | | — | | |
| | Water | | | 14.3 | | | | | 10 | | |
| | Formaldehyde | | | 9.0 | | | | | 10 | | |
| | Guar gum | | | 0.2 | | | | | 0.7 | | |
| | Aluminum powder | | | 12.8 | | | | | — | | |
| | Monomethylamine nitrate | | | — | | | | | 25 | | |
| | M-coated SaMB (Reference example 1) | 0.3 | — | — | — | 0.5 | 0.4 | — | — | — | 0.7 |
| | P-coated SaMB (Reference example 2) | — | 0.3 | — | — | — | — | 0.4 | — | — | — |
| | U-coated AcMB (Reference example 3) | — | — | 0.3 | — | — | — | — | 0.4 | — | — |
| | R-coated AcMB (Reference example 4) | — | — | — | 1.0 | — | — | — | — | 1.3 | — |
| Just after production | Specific gravity (g/cc) | 1.05 | 1.07 | 1.06 | 1.05 | 0.93 | 1.09 | 1.10 | 1.10 | 1.08 | 0.97 |
| | MIT (°C.) | −15 | −15 | −15 | −10 | −20 | −15 | −15 | −15 | −10 | −25 |
| | After-detonation fume CO (l/kg) | 3 | 3 | 4 | 4 | 4 | 4 | 3 | 3 | 4 | 4 |
| | After-detonation fume $NO_x$ (l/kg) | 4 | 3 | 4 | 3 | 4 | 3 | 4 | 3 | 4 | 3 |
| | BM (%) | 117 | 118 | 117 | 116 | 116 | 112 | 111 | 112 | 110 | 110 |
| One year after production | Specific gravity (g/cc) | 1.07 | 1.09 | 1.07 | 1.07 | 0.95 | 1.10 | 1.11 | 1.12 | 1.10 | 1.00 |
| | MIT (°C.) | −15 | −15 | −15 | −10 | −20 | −15 | −15 | −15 | −10 | −25 |

Note

M-coated SaMB: Vinylidene chloride-acrylonitrile-methyl methacrylate terpolymer resin hollow microspheres coated with melamine-formaldehyde resin P-coated SaMB: Vinylidene chloride-acrylonitrile-methyl methacrylate terpolymer resin hollow microspheres coated with phenol-formaldehyde resin U-coated AcMB: Acrylonitride-methyl methacrylate copolymer resin hollow microspheres coated with urea-formaldehyde resin R-coated AcMB: Acrylonitrile-methyl methacrylate copolymer resin hollow microspheres coated with resorcinol-formaldehyde resin

COMPARATIVE EXAMPLES 1–5

Slurry explosives were produced in the same manner as described in Examples 1–5, except that commonly known commercially available hollow-microspheres shown in Table 2 were used. A sample cartridge was produced from each of the resulting slurry explosives in the same manner as described in Examples 1–5, and subjected to the same performance tests as described in Examples 1–5. The obtained results are shown in Table 2.

COMPARATIVE EXAMPLES 6–10

Slurry explosives were produced in the same manner as described in Examples 6–10, except that commonly known commercially available hollow microspheres shown in Table 2 were used. A sample cartridge was produced from each of the resulting slurry explosives in the same manner as described in Examples 1–5, and subjected to the same performance tests as described in Examples 1–5. The obtained results are shown in Table 2.

TABLE 2

| | | Comparative example | | | | | | | | | |
|---|---|---|---|---|---|---|---|---|---|---|---|
| | | 1 | 2 | 3 | 4 | 5 | 6 | 7 | 8 | 9 | 10 |
| Compounding recipe (parts by weight) | Ammonium nitrate | | | 50.9 | | | | | 54.3 | | |
| | Sodium nitrate | | | 12.8 | | | | | — | | |
| | Water | | | 14.3 | | | | | 10 | | |
| | Formaldehyde | | | 9.0 | | | | | 10 | | |

TABLE 2-continued

| | | Comparative example | | | | | | | | | |
|---|---|---|---|---|---|---|---|---|---|---|---|
| | | 1 | 2 | 3 | 4 | 5 | 6 | 7 | 8 | 9 | 10 |
| | Guar gum | | | 0.2 | | | | | 0.7 | | |
| | Aluminum powder | | | 12.8 | | | | | — | | |
| | Monomethylamine nitrate | | | — | | | | | 25 | | |
| | GMB*1 | 2.1 | — | — | — | — | 2.8 | — | — | — | — |
| | SiMB*2 | — | 2.1 | — | — | — | — | 2.8 | — | — | — |
| | SaMB*3 | — | — | 0.3 | — | 0.5 | — | — | 0.4 | — | 0.7 |
| | PMB*4 | — | — | — | 2.4 | — | — | — | — | 3.1 | — |
| Just after production | Specific gravity (g/cc) | 1.06 | 1.06 | 1.07 | 1.05 | 0.92 | 1.10 | 1.09 | 1.11 | 1.09 | 0.96 |
| | MIT (°C.) | 5 | 10 | −15 | 0 | −20 | 5 | 10 | −15 | 5 | −25 |
| | After-detonation fume CO (l/kg) | 3 | 4 | 4 | 7 | 4 | 3 | 4 | 3 | 7 | 4 |
| | After-detonation fume $NO_x$ (l/kg) | 4 | 4 | 3 | 4 | 4 | 3 | 4 | 4 | 3 | 3 |
| | BM (%) | 109 | 108 | 116 | 115 | 115 | 103 | 102 | 111 | 110 | 110 |
| One year after production | Specific gravity (g/cc) | 1.07 | 1.08 | 1.23 | 1.07 | 1.16 | 1.12 | 1.11 | 1.25 | 1.11 | 1.19 |
| | MIT (°C.) | 10 | 10 | 15 | 5 | 10 | 5 | 15 | 15 | 10 | 10 |

*1GMB: glass hollow microspheres, trademark: Glass Bubbles B15/250, sold by Minesota Mining Manufacturing Co., average particle size: 75 μm, density: 0.15 g/cc.
*2SiMB: silica hollow microspheres, trademark: Silica Balloon NL, sold by Kushiro Sekitan Kanryu Co., average particle size: 400 μm, density: 0.15 g/cc.
*3SaMB: Saran hollow microspheres, trademark: Saran Microsphere, sold by Dow Chemical Co., average particle size: 25 μm, density: 0.032 g/cc.
*4PMB: phenolic resin hollow microspheres, trademark: Bakelite Phenolic Microballoon BJO-0931, sold by Union Carbide Corp., average particle size: 50 μm, density: 0.17 g/cc.

EXAMPLES 11–15

Water-in-oil emulsion explosives having a compounding recipe shown in Examples 11–15 in the following Table 3 were produced in the following manner.

To 14 parts of water were added 66 parts of ammonium nitrate and 15 parts of sodium nitrate, and the resulting mixture was heated to dissolve the nitrates in the water and to obtain an aqueous solution of the oxidizer salts kept at about 90° C. A mixture of 4 parts of liquid paraffin and 1 part of sorbitan monooleate was heated and melted to obtain a combustible material mixture kept at about 90° C.

The combustible material mixture was first charged into a heat-insulating vessel, and then the aqueous solution of the oxidizer salts was gradually added to the combustible material mixture while agitating the resulting mixture by means of a commonly used propeller blade-type agitator. After completion of the addition, the resulting mixture was further agitated at a rate of about 1,600 rpm for 5 minutes to obtain a water-in-oil emulsion kept at about 85° C.

Then, the water-in-oil emulsion was mixed with a given amount of each of the hollow microspheres obtained in Reference examples 1–4 in a kneader to obtain a water-in-oil emulsion explosive.

A sample cartridge was produced from each of the resulting water-in-oil emulsion explosives in the same manner as described in Examples 1–5, and subjected to the same performance tests as described in Examples 1–5. The obtained results are shown in Table 3.

EXAMPLES 16–18

Water-in-oil emulsion explosives having a compounding recipe shown in Examples 16–18 in Table 3 were produced in the same manner as described in Examples 11–15.

A sample cartridge was produced from each of the resulting water-in-oil emulsion explosives in the same manner as described in Examples 1–5, and subjected to the same performance tests as described in Examples 1–5. The obtained results are shown in Table 3.

EXAMPLES 19–21

Water-in-oil emulsion explosives having a compounding recipe shown in Examples 19–21 in Table 3 were produced in the same manner as described in Examples 11–15.

A sample cartridge was produced from each of the resulting water-in-oil emulsion explosives in the same manner as described in Examples 1–5, and subjected to the same performance tests as described in Examples 1–5. The obtained results are shown in Table 3.

TABLE 3

| | | Example | | | | | | | | | | |
|---|---|---|---|---|---|---|---|---|---|---|---|---|
| | | 11 | 12 | 13 | 14 | 15 | 16 | 17 | 18 | 19 | 20 | 21 |
| Compounding recipe (parts by weight) | Ammonium nitrate | | | 66 | | | | 63 | | | 66 | |
| | Sodium nitrate | | | 15 | | | | 10 | | | — | |
| | Sodium perchorate | | | — | | | | 10 | | | — | |
| | Monomethylamine nitrate | | | — | | | | — | | | 15 | |
| | Water | | | 14 | | | | 12 | | | 14 | |
| | Microcrystalline wax | | | — | | | | 3 | | | 4 | |
| | Liquid paraffin | | | 4 | | | | 1 | | | — | |
| | Sorbitan monooleate | | | 1 | | | | 1 | | | 1 | |
| | M-coated SaMB (Reference example 1)* | 0.7 | — | — | — | 1.5 | 0.4 | — | 1.0 | 0.3 | — | 1.0 |
| | P-coated SaMB (Reference example 2)* | — | 0.7 | — | — | — | — | 0.4 | — | — | 0.3 | — |
| | U-coated AcMB (Reference example 3)* | — | — | 0.7 | — | — | — | — | — | — | — | — |
| | R-coated AcMB (Reference example 4)* | — | — | — | 2.4 | — | — | — | — | — | — | — |

TABLE 3-continued

| | | | Example | | | | | | | | | | |
|---|---|---|---|---|---|---|---|---|---|---|---|---|---|
| | | | 11 | 12 | 13 | 14 | 15 | 16 | 17 | 18 | 19 | 20 | 21 |
| Just after production | Specific gravity (g/cc) | | 1.06 | 1.05 | 1.06 | 0.95 | 0.91 | 1.12 | 1.11 | 0.92 | 1.10 | 1.11 | 0.90 |
| | MIT (°C.) | | −15 | −15 | −15 | −20 | −20 | −25 | −25 | −30 | −25 | −25 | −30 |
| | After-detonation fume | CO (l/kg) | 4 | 3 | 3 | 4 | 5 | 4 | 3 | 4 | 4 | 3 | 4 |
| | | $NO_x$ (l/kg) | 3 | 3 | 4 | 4 | 4 | 3 | 3 | 4 | 4 | 4 | 4 |
| | BM (%) | | 110 | 109 | 110 | 110 | 110 | 107 | 106 | 106 | 116 | 115 | 117 |
| One year after production | Specific gravity (g/cc) | | 1.07 | 1.06 | 1.07 | 0.98 | 0.93 | 1.13 | 1.13 | 0.94 | 1.12 | 1.12 | 0.93 |
| | MIT (°C.) | | −15 | −15 | −10 | −15 | −15 | −25 | −25 | −25 | −25 | −25 | −25 |

*Same hollow microspheres as described in Table 1

COMPARATIVE EXAMPLES 11–22

Water-in-oil emulsion explosives having a compounding recipe shown in Comparative examples 11–22 in the following Table 4 were produced in the same manner as described in Examples 11–15, except that commonly known commercially available hollow microspheres shown in Table 4 were used as hollow microspheres.

A sample cartridge was produced from each of the resulting water-in-oil emulsion explosives in the same manner as described in Examples 1–5, and subjected to the same performance tests as described in Examples 1–5. The obtained results are shown in Table 4.

TABLE 4

| | | Comparative example | | | | | | | | | | | |
|---|---|---|---|---|---|---|---|---|---|---|---|---|---|
| | | 11 | 12 | 13 | 14 | 15 | 16 | 17 | 18 | 19 | 20 | 21 | 22 |
| Compounding recipe (parts by weight) | Ammonium nitrate | | 66 | | | | 63 | | | | 66 | | |
| | Sodium nitrate | | 15 | | | | 10 | | | | — | | |
| | Sodium perchorate | | — | | | | 10 | | | | — | | |
| | Monomethylamine nitrate | | — | | | | — | | | | 15 | | |
| | Water | | 14 | | | | 12 | | | | 14 | | |
| | Microcrystalline wax | | — | | | | 3 | | | | 4 | | |
| | Liquid paraffin | | 4 | | | | 1 | | | | — | | |
| | Sorbitan monooleate | | 1 | | | | 1 | | | | 1 | | |
| | GMB*1 | 5.5 | — | — | — | 3.0 | — | — | — | 2.8 | — | — | — |
| | SiMB*2 | — | 5.5 | — | — | — | 3.0 | — | — | — | 2.8 | — | — |
| | SaMB*3 | — | — | 0.7 | — | — | — | 0.4 | — | — | — | 0.3 | — |
| | PMB*4 | — | — | — | 6.2 | — | — | — | 3.5 | — | — | — | 3.3 |
| Just after production | Specific gravity (g/cc) | 1.05 | 1.06 | 1.21 | 1.07 | 1.11 | 1.12 | 1.23 | 1.11 | 1.10 | 1.11 | 1.22 | 1.12 |
| | MIT (°C.) | 5 | 10 | 15 | 5 | 5 | 5 | 10 | 5 | 5 | 5 | 10 | 5 |
| | After-detonation fume CO (l/kg) | 4 | 3 | 5 | 8 | 4 | 3 | 5 | 7 | 4 | 3 | 5 | 7 |
| | After-detonation fume $NO_x$ (l/kg) | 3 | 3 | 4 | 4 | 3 | 4 | 4 | 3 | 4 | 4 | 3 | 4 |
| | BM (%) | 95 | 93 | 106 | 105 | 97 | 95 | 107 | 106 | 103 | 104 | 113 | 114 |
| One year after production | Specific gravity (g/cc) | 1.07 | 1.08 | 1.25 | 1.09 | 1.11 | 1.14 | 1.25 | 1.12 | 1.13 | 1.12 | 1.24 | 1.14 |
| | MIT (°C.) | 10 | 15 | 20 | 10 | 10 | 10 | 15 | 10 | 10 | 10 | 15 | 10 |

*1–*4 are the same as *1–*4 described in Table 2.

It can be seen from the above described experiments that slurry explosive compositions containing specifically limited hollow microspheres according to the present invention (refer to Table 1) are remarkably superior to slurry explosive compositions containing commonly known hollow microspheres (refer to Table 2) in the low temperature detonability after lapse of time represented by the lowest detonation temperature one year after the production; and further the former slurry explosive compositions of the present invention are superior to the latter conventional slurry explosive compositions in the after-detonation fume and strength just after the production.

In the water-in-oil emulsion explosive composition also, it can be seen that water-in-oil emulsion explosive compositions containing specifically limited hollow microspheres according to the present invention (refer to Table 3) are remarkably superior to water-in-oil emulsion explosive compositions containing commonly known hollow microspheres (refer to Table 4) in the low temperature detonabilities just after the production and after lapse of time represented by the lowest detonation temperatures just after the production and one year after the production; and further the former water-in-oil emulsion explosive compositions of the present invention are superior to the latter conventional water-in-oil emulsion explosive compositions in the after-detonation fume and strength just after the production.

What is claimed is:

1. In an explosive composition containing micro-voids, the improvement comprising the micro-voids being formed of thermoplastic resin hollow microspheres coated with a thermosetting resin.

2. An explosive composition according to claim 1, wherein the hollow microspheres have an average particle size of 20–150 μm and a density of 0.007–0.1 g/cc.

3. An explosive composition according to claim 1, wherein the thermoplastic resin is one member selected from the group consisting of vinylidene chloride-acrylonitrile-methyl acrylate terpolymer resin, acrylonitrile-methyl methacrylate copolymer resin, vinylidene chloride-acrylonitrile-methyl methacrylate terpolymer resin and vinylidene chloride-acrylonitrile-vinyl acetate terpolymer resin.

4. An explosive composition according to claim 1, wherein the thermosetting resin is one member selected from the group consisting of melamine-formaldehyde resin, phenol-formaldehyde resin, urea-formaldehyde resin, resorcinol-formaldehyde resin, epoxy resin, unsaturated polyester resin, silicone resin and furan resin.

5. An explosive composition according to claim 1, wherein the compounding amount of the hollow microspheres is 0.05–4% by weight based on the total amount of the explosive composition.

6. An explosive composition according to claim 1, wherein the explosive composition is a water-gel explosive composition.

7. An explosive composition according to claim 6, wherein the water-gel explosive composition is a slurry explosive composition.

8. An explosive composition according to claim 6, wherein the water-gel explosive composition is a water-in-oil emulsion explosive composition.

9. An explosive composition according to claim 7, wherein the slurry explosive composition comprises inorganic oxidizer salts, water, a combustible material, a sensitizer, a thickener and micro-voids.

10. An explosive composition according to claim 8, wherein the water-in-oil emulsion explosive composition comprises a disperse phase formed of an aqueous solution of inorganic oxidizer salts; a continuous phase formed of combustible material consisting of oil; emulsifier; and micro-voids.

11. An explosive composition according to claim 9 or 10, wherein the inorganic oxidizer salts consist mainly of ammonium nitrate.

* * * * *